US007930789B2

(12) United States Patent
Hollander

(10) Patent No.: US 7,930,789 B2
(45) Date of Patent: Apr. 26, 2011

(54) SPIKE/SHOE CLEANER

(76) Inventor: William Hollander, East Patchogue, NY (US)

( * ) Notice: Subject to any disclaimer, the term of this patent is extended or adjusted under 35 U.S.C. 154(b) by 413 days.

(21) Appl. No.: 12/220,107

(22) Filed: Jul. 23, 2008

(65) Prior Publication Data

US 2009/0038096 A1 Feb. 12, 2009

Related U.S. Application Data

(60) Provisional application No. 60/963,406, filed on Aug. 6, 2007.

(51) Int. Cl.
*A47L 23/22* (2006.01)

(52) U.S. Cl. ..... 15/36; 15/161

(58) Field of Classification Search ..... 15/36, 161; *A47L 23/42*

See application file for complete search history.

(56) References Cited

U.S. PATENT DOCUMENTS

| | | | | | |
|---|---|---|---|---|---|
| 2,895,159 | A * | 7/1959 | Ostrow | ..... | 15/311 |
| 3,048,867 | A | 8/1962 | Counts | | |
| 3,060,475 | A * | 10/1962 | Dufault | ..... | 15/36 |
| 3,226,750 | A | 1/1966 | Leonard | | |
| 3,737,942 | A | 6/1973 | Casey | | |
| 3,938,218 | A | 2/1976 | DeAmicis | | |
| 4,233,707 | A | 11/1980 | Leblanc | | |
| 5,991,967 | A * | 11/1999 | Williams | ..... | 15/311 |
| 6,105,201 | A | 8/2000 | Min | | |
| 6,406,549 | B1 * | 6/2002 | Berg et al. | ..... | 134/1 |

* cited by examiner

*Primary Examiner* — Monica S Carter
*Assistant Examiner* — Stephanie Newton
(74) *Attorney, Agent, or Firm* — Evelyn M. Sommer

(57) ABSTRACT

Footwear cleaning apparatus includes a receptacle well filled with a cleaning solution and a rotating brush. The rotating brush is supported by telescoping stems that extend and retract the rotating brush. In one embodiment, retracting a cover for the receptacle well activates the rotating brush, thus allowing a user to clean the sole of the footwear. In another embodiment, a sensor senses the presence of a user and automatically activates the rotating brush and telescoping stems for the apparatus to be used.

13 Claims, 4 Drawing Sheets

SPIKE/SHOE CLEANER

CROSS-REFERENCE TO RELATED APPLICATIONS

This application claims priority to U.S. Provisional Application No. 60/963,406 filed Aug. 6, 2007, entitled "Spike/Shoe Cleaner," William Hollander, inventor, which application is incorporated herein by reference for all purposes as though fully set forth herein.

BACKGROUND OF THE INVENTION AND RELATED ART

The present invention relates to an apparatus for removing debris from spikes and/or cleats mounted on shoes, boots and other footwear (hereinafter, "footwear"), and, in general, is employed while standing over or near the device and placing one footwear across the top of the device to have the debris removed, and then bringing the other footwear to be cleaned likewise. Examples of footwear having spikes and/or cleats include golf shoes, baseball shoes, and so on.

Footwear with spikes on the sole are often used on a natural field or ground. Since the spikes are attached to the shoes, soil is likely to stick to the shoes. Also, the shoes with the spikes are generally carried to a specific place, and after use, the shoes are taken off and are brought back with or without a cover. Therefore, it is preferable to clean the shoes after use to easily carry the shoes.

For example, golf shoes are used in a natural field, and soil is likely to attach to them. Also, in a golf course, in order to maintain lawn or grasses on a field and green, a large amount of chemical is put on the field and green. In addition, when a person returns indoors after walking through soil, mud, dust, or other material, the presence of which is not desirable indoors, it is advisable to clean the footwear either just before entry or upon entry to make certain the undesirable material is not tracked further inside. Therefore, it is preferable to clean the golf shoes after use.

Prior devices have been used to remove soil from the golf shoe. One device, for example, ejects high pressure air from a nozzle. In this device, soil is blown away by high pressure air ejected from a nozzle handled by a user, but the removed soil scatters all around the area. In this respect, though the subject to be used is different, U.S. Pat. No. 3,938,218 discloses a nozzle to eject pressurized air to remove an attachment. In these mechanisms, soil attached to the shoes can be removed, but chemicals attached to the shoes are not removed.

A golf shoe cleaner was proposed in U.S. Pat. No. 3,226,750, which includes two large wheels with axial bristles, and a shaft connecting the large wheels and having radial bristles projecting outwardly from the shaft. The axial bristles projecting from the large wheels face two sides of a shoe, and the radial bristles contact a sole, by which soil attached to the shoe is removed. In this mechanism, soil attached to the shoe is removed, but chemicals adhered to the shoe is not removed. To remove such chemicals, U.S. Pat. No. 6,105,201 disclosed the use of moisture together with compressed air, not pressured water, through a nozzle.

As regular shoe cleaners, there are many devices, such as U.S. Pat. Nos. 3,737,942, 4,233,707 and 3,048,867. In these devices, brushes are rotated to contact a shoe to remove soil attached thereto. Soil removed from the shoe may be collected by a vacuum force, and air may be projected to remove an upper part of the shoe. Further, hot air may be ejected from a device to dry the shoe.

In view of the above, the present invention has been made, and an object of the invention is to provide a shoe cleaning device which can effectively remove soil attached to a shoe, especially shoe with spikes, without scattering soil around the shoe.

Another object of the invention is to provide a shoe cleaning device as stated above, which can also remove chemicals attached to the shoe.

A further object of the invention is to provide a shoe cleaning device as stated above, which can be formed and operated easily.

Further objects and advantages of the invention will be apparent from the following description of the invention.

SUMMARY OF THE INVENTION

The present invention relates to footwear cleaning apparatus which includes a well receptacle. Integrally connected to the bottom of the receptacle, two motor-controlled, telescoping stems supporting a circular, rotating brush, which features heavy-duty yet gentle bristles for cleaning the sole of a footwear without damage. Brushes may be of nylon construction, for example, and it is preferable that the bristles for the brushes be of such a character that they do not hold contamination or spread any particles that are of contagious nature.

A unit of the invention may be located on the outside of an entry into a building or it may be placed inside a hallway or foyer of the building or at any other location where needed. There are numerous other locations which would be desirable for the apparatus of the invention such as, for example, golf courses, residential homes, or other places that could benefit from such an apparatus.

The user activates the inventive device for use by use of a switch that may be activated by, for example, retracting a cover for the device. Once the cover is retracted, the device is activated, causing the telescoping stems to rise and the brush to spin. The sole of the footwear would be placed against the rotating brush, and the user would maneuver the footwear to make sure the brush reaches between each spike. After each footwear has been cleaned, pressure would be applied on the brush with the user's foot to deactivate the device. Once the user has left the device, the cover slides back.

In a preferred embodiment, the well receptacle is adapted for containing a liquid cleaning solution and the brush is immersed in the liquid cleaning solution prior to use of the inventive device by the user. When the cover is retracted and the device is activated, the telescoping stems rise from the cleaning solution and raise the brush to such a level that the top of the brush is accessible to the user's sole for cleaning and the bottom of the brush is at least partially in contact with the cleaning solution. As a result, the spinning action of the brush allows the bristles having cleaning solutions thereon to come into contact with the user's sole after a partial revolution and the bristles having removed soils from the user's sole to come into contact with the cleaning solution after the a partial revolution. The inclusion of a cleaning liquid serves to improve the cleaning efficacy.

Accordingly, a principal feature of the present invention is the provision of apparatus having these characteristics and advantages. Another feature of the present invention is the provision of such apparatus that is sturdy and capable of long trouble-free use. Yet another feature of the present invention is the provision of a device of the aforesaid type that ensures adequate cleaning of the under and side surfaces of a shoe, which normally are subject to the greatest accumulation of dirt, and which cleans the upper surface of the shoe as well. Other and further features, advantages, and benefits of the invention will become apparent in the following description taken in conjunction with the following drawings.

It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
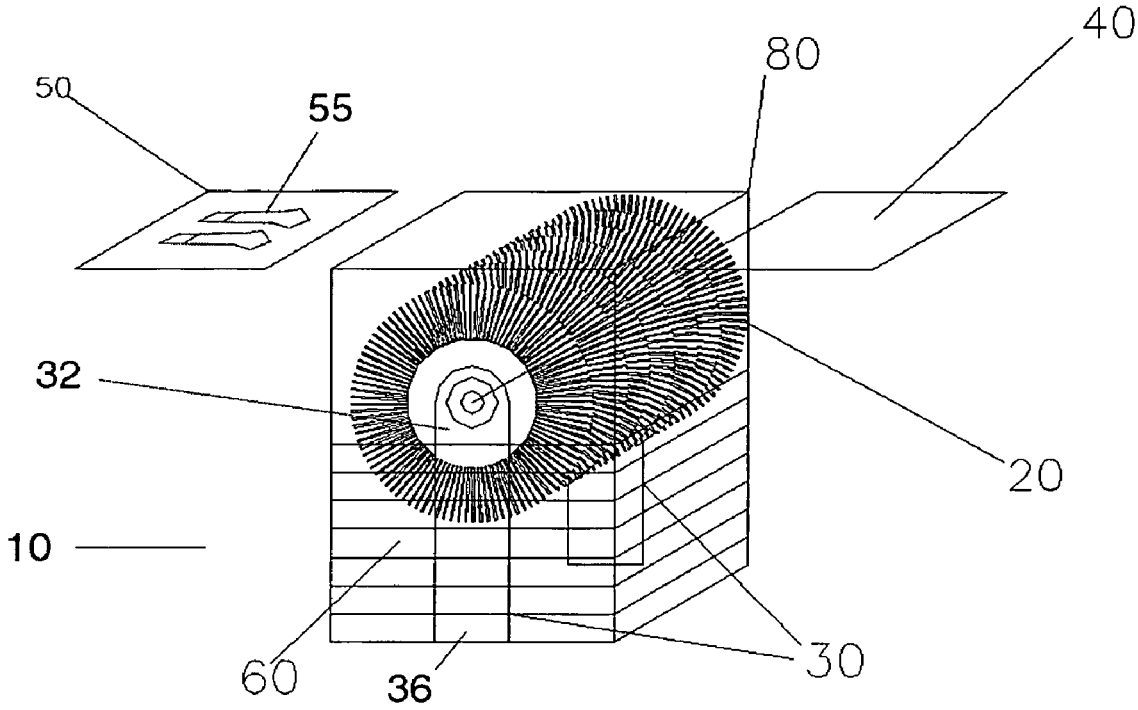
FIG. 1 is a perspective overview of an embodiment of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring to FIG. 1, there is shown a perspective view of shoe cleaner 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
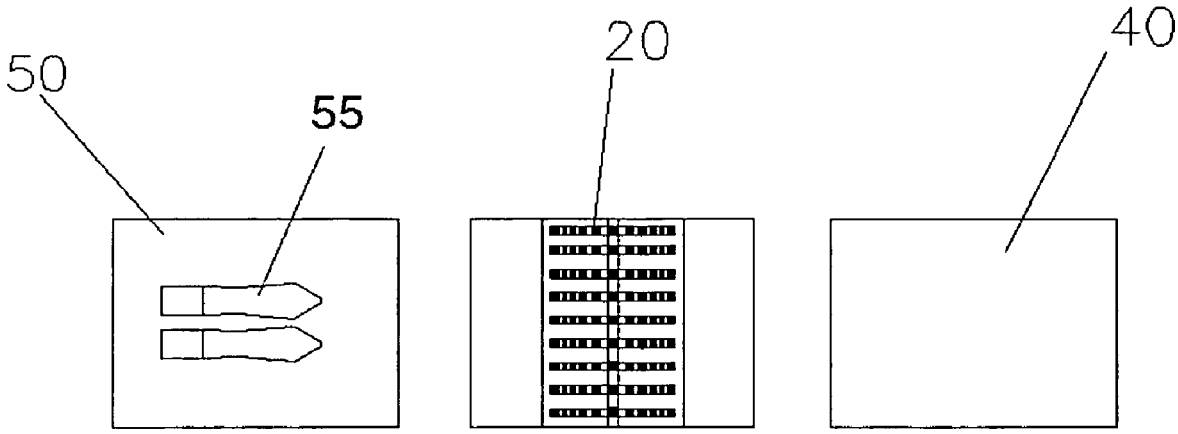
FIG. 2 is a top plan of the embodiment depicted in FIG. 1.
Figure 3:
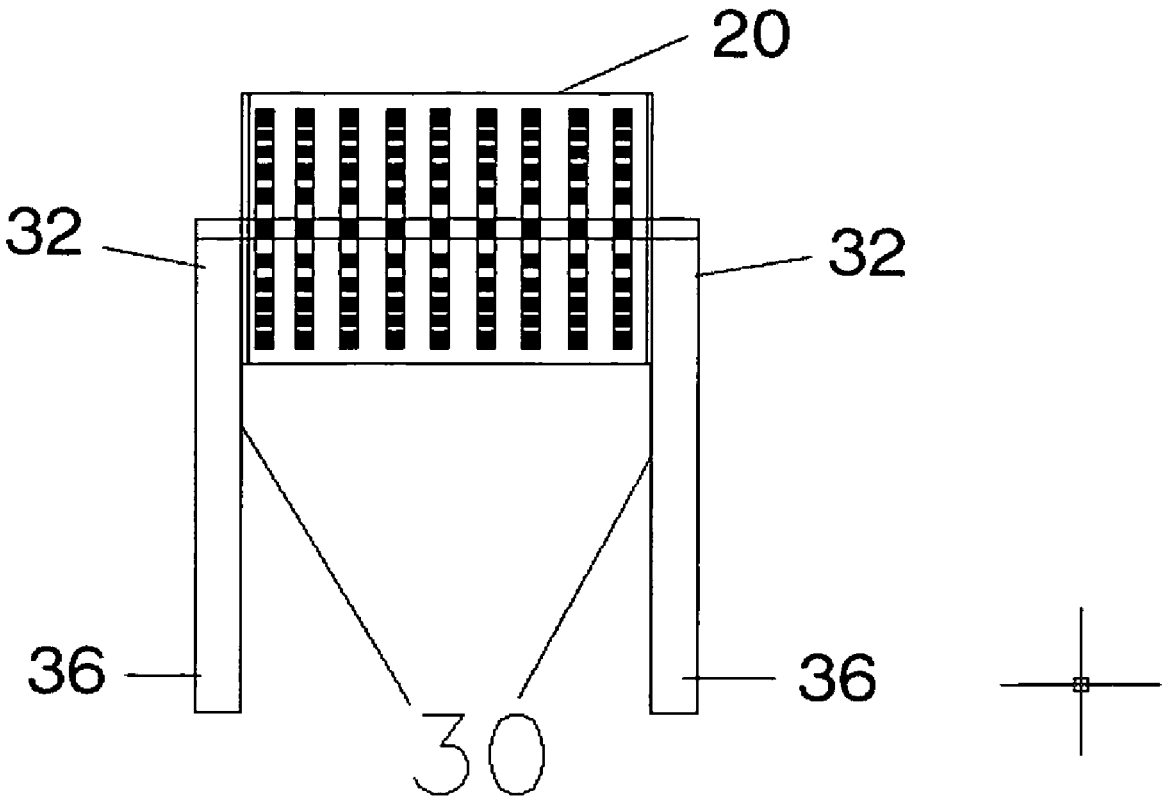
FIG. 3 is a side plan of a telescoping stem and rotating brush of the embodiment depicted in FIG. 1.

Viewing now FIGS. 1-3, the shoe cleaner 10 is seen to include a well receptacle 80 having five walls including four walls connected in series forming a tube-like structure and a fifth wall closing the tube on one end, a cover 40, two telescoping stems 30, rotating brush 20, and a sensor 50. The walls of the receptacles can be constructed out of any conventional materials suitable for containing an cleaning solution and the parts therein, for example, metal sheets, plastic or composite sheets. The bristles of the brush are supported on an axel. Each of the two telescoping stems 30 has an upper end 32 and a lower end 36. The two lower ends 36 of the telescoping stems are fixedly attached to the bottom and/or a sidewall of the receptacle. Each of the upper ends of the telescoping stems has a bearing to which the corresponding end of the axel of the brush is rotatably engaged. As a result, the brush is suspended between the two telescoping stems and the brush is moved between an extended position (during use or in preparation for use) and a retracted position (for storage) through the telescoping motion of the two telescoping stems. The telescoping actions of the telescoping stems are driven by one drive or two separate drives operating in synchrony. The drive, preferably in the form of an electrical motor, is powered either by a DC (e.g. batteries) or AC source. Another drive is provided and coupled to the axel to drive the brush. The coupling can be accomplished in any conventional manner, such as through the use of a belt connecting the motor and the axel of the brush. The telescoping stems can be constructed in any conventional manner. The cover can be in either a retraced position or a closed position. When in the closed position, the cover seals off the open end of the tube-like structure of the receptacle. Retraction of the cover exposes the brush to the user and allows the brush to be raised by the telescoping stems to a position that is high enough to contact the sole of the shoe that is to be cleaned. Therefore, the cover is to be retracted in preparation for use and should stay retracted during use. Upon the completion of the cleaning procedure and the retraction of the brush, the cover is to be returned to the original closed position, forming a sealed container in conjunction with the other five walls and enclosing the brush (now retracted) therein. Any conventional means for opening or closing the cover can be employed. In one embodiment the cover is attached to an adjoining wall through a hinge and the cover is swung open or closed. In another embodiment, the cover rests on the rims of three adjoining walls and is slid open or closed. Well receptacle 80 preferably contains a cleaning solution 60, which is a quick-drying conventional cleaning solution that is known in the art. The cleaning solution can contain a detergent in the form of an ionic (anionic or cationic) or non-ionic surfactant dispersed in water. One such quick-drying conventional cleaning solution is LYSOL® 4-in-1 cleaning solution. Well receptacle 80, in one embodiment, is approximately 12"×12"×12", although other measurements may be used so long as the well receptacle 80 can house rotating brush 20 large enough to clean the soles of footwear. The figures presently depict cover 40 in a retracted position, i.e., where the rotating brush 20 is exposed. Although only one rotating brush 20 is shown, additional brushes may be used as desired. In its non-retracted position, cover 40 completely covers well receptacle 80. Sensor 50 detects the presence of a user who wishes to operate the shoe cleaner 10. As depicted in FIGS. 1 and 2, sensor 50 is a pad comprising a load switch 55, which asserts a signal 100 in the event a load is present on top of the sensor 50. It is to be understood, however, that any mechanism may be used to determine the presence of a potential user of the shoe cleaner 10 to generate the signal 100 when appropriate. For example, sensor 50 may be in the form of an optical detector that generates the signal 100 when a user is present.

In operation, when a user activates sensor 50, signal 100 is used to trigger a series of events. First, cover 40 is retracted. After the cover 40 is retracted, rotating brush 20 is activated, and telescoping stems 30 raise rotating brush 20 to a level that is accessible by the user. The user would then place the sole of the footwear against the rotating brush 20, maneuvering the sole of the footwear to make sure that the rotating brush 20 completely cleans the sole of the footwear and, when cleats are present on the sole of the footwear, that the rotating brush reaches between each spike. When a cleaning solution is present in the well receptacle, the solution is present in such an amount that at the level suitable for cleaning actions, the brush is partially (at its bottom portion) in contact with the cleaning solution. As a result, the spinning action of the brush allows the bristles having cleaning solutions thereon to come into contact with the user's sole after a partial revolution and the bristles having removed soils from the user's sole to come into contact with the cleaning solution after the a partial revolution.

When the cleaning is completed, the user simply steps off sensor 50 to shut off the shoe cleaner 10. Once the user steps off sensor 50, signal 100 becomes non-asserted, causing a series of events. First, the rotating brush 20 stops and the telescoping stems 30 are retracted. Once the telescoping stems 30 are retracted, cover 40 is then retracted thus covering well receptacle 80.

The sequence of activation or deactivation of telescoping stems 30 and the rotating brush 20 is not critical. One may precede the other or they may happen concurrently. However, it is critical that, on activation of the shoe cleaner 10, the cover 40 first be retracted prior to the extension of telescoping stems 30. Likewise, it is critical, on deactivation of the shoe cleaner 10, that telescoping stems 30 first be retracted prior to the closing of the cover 40.

Figure 4:
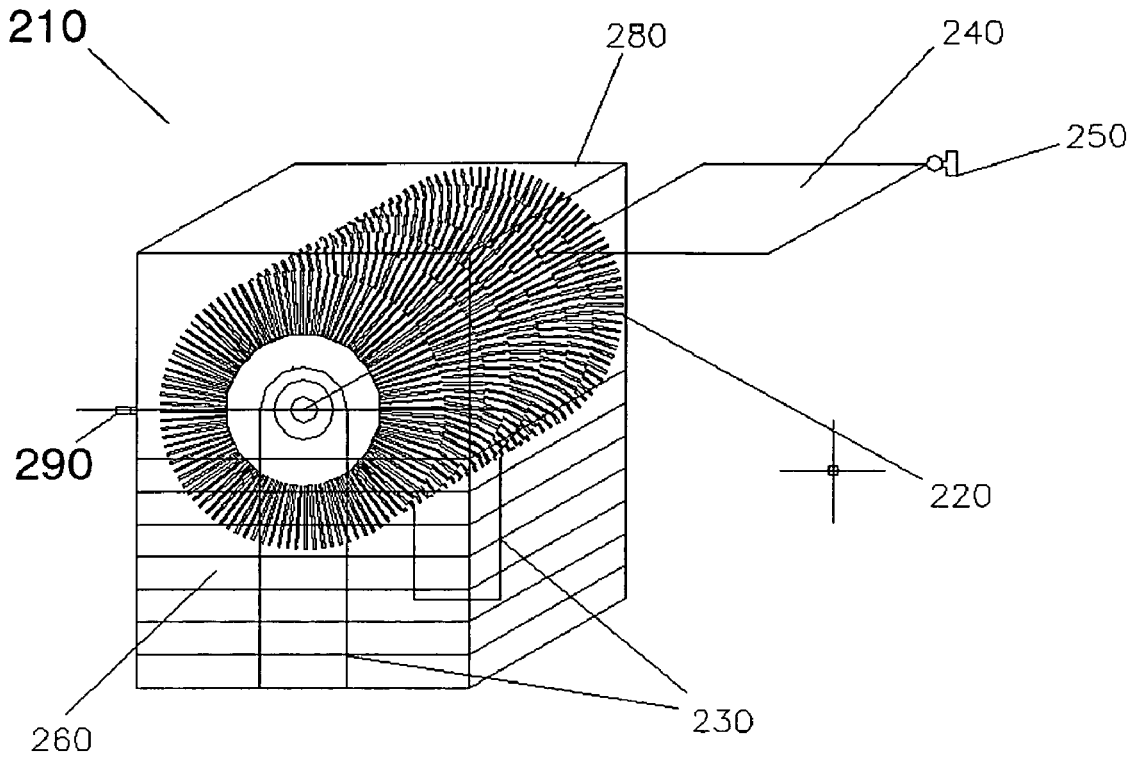
FIG. 4 is a perspective overview of another embodiment of the present invention.

FIG. 4 depicts a shoe cleaner 210, which is an embodiment similar to the shoe cleaner 10 described in FIGS. 1-3. The shoe cleaner 210 of FIG. 4, however, does not have a sensor 50. Essentially, shoe cleaner 210 comprises a well receptacle 280 having five walls, a cover 240, telescoping stems 230, and rotating brush 220. Well receptacle 280 is preferably filled with cleaning solution 260. FIG. 4 presently depicts cover 240 in a retracted position, i.e., where the rotating brush 220 is exposed. In its non-retracted position, cover 240 completely covers well receptacle 280.

In operation, a user activates shoe cleaner 210 by first retracting cover 240. In one embodiment, cover 240 comprises tabs 300 and 310 to allow ease of retraction by the user of cover 240. In another embodiment, cover 240 may be attached to one top side of well receptacle 280 such as, for example, by a hinge. Other embodiments may be used without departing from the spirit of the present invention. Retracting cover 240 activates a start switch 250 which, in turn, activates rotating brush 220 and telescoping stems 230. Thus, after the cover 240 is retracted, rotating brush 220 is activated, and telescoping stems 230 raise rotating brush 220 to a level that is accessible by the user. The user would then place the sole of the footwear against the rotating brush 220, maneuvering the sole of the footwear to make sure that the rotating brush 220 completely cleans the sole of the footwear and, when cleats are present on the sole of the footwear, that the rotating brush reaches between each spike. As described above, when a cleaning solution is present in the well receptacle, the solution is present in such an amount that at the level suitable for cleaning actions, the brush is partially (at its bottom portion) in contact with the cleaning solution.

When the cleaning is completed, the user simply applies pressure on the rotating brush 220, activating a stop switch 290, causing rotating brush 220 to stop rotating and concurrently causing the telescoping stems 230 to retract. The user can them simply slide the cover 240 to cover well receptacle 280.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A shoe cleaner comprising:
a well receptacle;
a cover for the well receptacle;
a cleaning mechanism;
a sensor for sensing a potential user of the shoe cleaner;
wherein the cover is retracted to make the cleaning mechanism available when the sensor is activated by the potential user; and
wherein the sensor activates the cleaning mechanism for use by the potential user.

2. The shoe cleaner of claim 1, further comprising a telescoping means in said well receptacle for engaging said cleaning mechanism and adjusting the height of the cleaning mechanism, wherein said sensor activates the telescoping means.

3. The shoe cleaner of claim 2, wherein said telescoping means are two telescoping stems.

4. The shoe cleaner of claim 1, wherein said cleaning mechanism is a brush.

5. The shoe cleaner of claim 1, further comprising a cleaning solution contained in the well receptacle, wherein the cleaning mechanism is immersed in the cleaning solution.

6. A shoe cleaner comprising:
a well receptacle;
a cleaning mechanism;
a cover for the receptacle well;
sensor for activating the cleaning mechanism;
a starter switch;
wherein a potential user retracts the cover prior to using the shoe cleaner;
wherein the retraction of the cover activates the start switch which in turn activates the cleaning mechanism.

7. The shoe cleaner of claim 6, further comprising a telescoping means in said well receptacle for engaging said cleaning mechanism and adjusting the height of the cleaning mechanism, wherein said sensor activates the telescoping means.

8. The shoe cleaner of claim 7, wherein said telescoping means are two telescoping stems.

9. The shoe cleaner of claim 6, wherein said cleaning mechanism is a brush.

10. The shoe cleaner of claim 6, further comprising a cleaning solution contained in the well receptacle, wherein the cleaning mechanism is immersed in the cleaning solution.

11. A shoe cleaner comprising:
a well receptacle;
a cleaning solution;
a cleaning mechanism;
a cover for the receptacle well; and
a sensor for determining the presence of a potential user, a telescoping means in said well receptacle for engaging said cleaning mechanism and adjusting the height of the cleaning mechanism,
wherein said sensor activates the telescoping means, wherein the well receptacle is filled with the cleaning solution and the cleaning mechanism is immersed in the cleaning solution inside the well receptacle, wherein a potential user retracts the cover prior to using the shoe cleaner, and wherein the retraction of the cover activates the cleaning mechanism.

12. The shoe cleaner of claim 11, wherein said telescoping means are two telescoping stems.

13. The shoe cleaner of claim 11, wherein said cleaning mechanism is a brush.

* * * * *